United States Patent [19]

Young et al.

[11] Patent Number: 4,722,485

[45] Date of Patent: Feb. 2, 1988

[54] GRINDING MILL CONTROL

[75] Inventors: Guy J. C. Young, Johannesburg; Malcolm S. Mellor, Welkom; Willem J. Harmse, Virginia, all of South Africa

[73] Assignee: Crucible Societe Anonyme, Luxembourg

[21] Appl. No.: 862,775

[22] Filed: May 13, 1986

[30] Foreign Application Priority Data

May 14, 1985 [ZA] South Africa ..... 85/3617

[51] Int. Cl.[4] ..... B02C 17/18

[52] U.S. Cl. ..... 241/179; 241/34; 241/301

[58] Field of Search ..... 241/34, 170, 179, 301

[56] References Cited

U.S. PATENT DOCUMENTS

| | | | |
|---|---|---|---|
| 2,235,928 | 3/1941 | Hardinge | 241/34 |
| 2,405,059 | 7/1946 | Sahmel | 241/33 |
| 2,833,482 | 5/1958 | Weston et al. | 241/30 |
| 4,367,522 | 1/1983 | Forstbauer et al. | 363/137 |

FOREIGN PATENT DOCUMENTS 0037001 3/1981 European Pat. Off. .

*Primary Examiner*—Timothy V. Eley

*Attorney, Agent, or Firm*—Woodard, Emhardt, Naughton, Moriarty & McNett

[57] ABSTRACT

The level of a grinding charge in a grinding mill is monitored by comparing signals which are generated by means of two sensors which are located on opposed sides of an impact point of the material in the mill. A signal produced in the comparison step may be used to control the feeding of material to the mill.

4 Claims, 2 Drawing Figures

GRINDING MILL CONTROL

BACKGROUND OF THE INVENTION

This invention relates to a method of and apparatus for monitoring a level of a grinding charge in a grinding mill. The invention is particularly concerned with autogenous and semi-autogenous mills and finds application in run of mine milling processes employed on gold and platinum mines.

In run of mine milling it is necessary to maintain the feed rate of uncrushed ore into a mill at an optimum level in order to produce the desired fineness in the end product.

If the feed rate is too high the mill overloads and if the feed rate is too low the mill becomes underloaded. In both cases the mill efficiency deteriorates rapidly.

A mill of the kind referred to includes a cylinder which is rotated by means of a motor. The mill load within the cylinder is caused to rotate and cascades onto an impact point inside the cylinder. The position of the impact point is related to the level of the charge and a microphone has been used in the past to establish the location of the impact point. The microphone detects the sound level caused mainly by the impacting load and as the sound level varies when the location of the impact point changes an operator is able, through experience, to alter the feed rate of the ore into the mill accordingly. Thus as the loading of the mill is increased the point of impact rises and conversely if the charge level drops so does the impact point. Clearly if use is made of a microphone to detect the sound level at the point of impact then the microphone will provide an indication of optimum operating conditions. However if there is a reduction in sound level then the microphone is not able to indicate whether the rate of feed of ore should be increased or reduced.

Sound-based systems of this kind are described for example in the specifications of U.S. Pat. Nos. 2,766,941 and 2,235,928. The specifications of UK Pat. No. 1105974 and U.S. Pat. No. 3314614 relate to the use of separate microphones for separate compartments in a multi-chamber mill, while the specification of U.S. Pat. No. 2,833,482 discloses the use of a first microphone at the "solids" end of the mill and a separate microphone at the "water" end of the mill.

U.S. Pat. No. 2,405,059 is concerned with a mill control system which makes use of multiple sensors which are in physical contact with the rotating mill shell. The objective is to eliminate errors which are present in devices which are responsive to air-borne vibrations. The sensors are symmetrically positioned around the shell to give "average values of grinding performance".

Russian Pat. No. 869 809 shows a sonic method of diagnosis of the state of a ball mill and grinding process which uses at least three inductive sensors disposed around the periphery of the ball mill. A gradient signal which is produced by the sensors is used to define the dynamics of the process. Signals are also obtained for the mill content, and the degree of filling of the mill.

A more recent approach to the problem has been to incorporate a load cell in the foundations of a grinding mill. The cell monitors the mill mass and this, in conjunction with data on the power drawn by the mill motor, is used to control the rate at which ore is fed to the mill. This technique however does not lend itself to incorporation in existing mills which do not have the facility for inclusion of a load cell.

SUMMARY OF THE INVENTION

The invention provides a method of monitoring a level of a grinding charge in a grinding mill which rotates and thereby causes the charge to cascade on to an impact point within the mill, the location of the impact point being dependent at least on the grinding charge level, the method including the step of detecting the prevailing sound level at least at two positions, generating signals which are respectively dependent on the detected sound levels, and comparing the signals. The positions may be spaced from one another in the direction of rotation of the mill. Preferably the positions are respectively on opposed sides of the impact point.

In this way an indication is obtained of the position of the impact point or of the direction of movement of the impact point away from an potimum location which corresponds to an optimum charge level within the mill.

A control signal may be produced in the comparison step. The control signal may be used to provide a display of the impact point position or to regulate the feed rate of ore into the mill, in both cases relatively to the optimum location of the impact point i.e. the optimum charge level.

The invention also provides apparatus for monitoring a level of a grinding charge in a grinding mill which rotates and thereby causes the charge to cascade on to an impact point within the mill, the location of the impact point being dependent on the grinding charge level, the apparatus including at least two sensors for detecting the prevailing sound level, the sensors being spaced from each other in the direction of mill rotation with the impact point between the sensors, and means for comparing signals which are produced by the sensors.

The sensors are preferably positioned so that they are equidistant from an impact point which corresponds to an optimum charge level.

The comparison means may generate a control signal which is used for regulating the rate of feed of ore into the mill. The apparatus may also include a display which is indicative of the position of the impact point.

BRIEF DESCRIPTION OF THE DRAWING

The invention is further described by way of example with reference to the accompanying drawings in which.

DESCRIPTION OF PREFERRED EMBODIMENT

Figure 1:
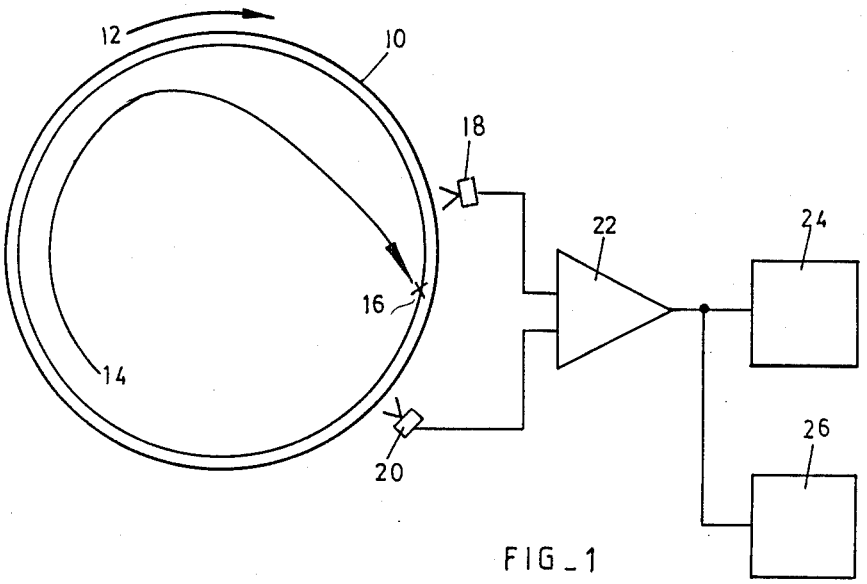
FIG. 1 diagrammatically illustrates in cross-section a grinding mill which uses apparatus according to the invention.

FIG. 1 illustrates schematically a cylinder 10 of a grinding mill which is charged in a conventional manner with ore. The cylinder 10 rotates in the direction of an arrow 12 and, due to the rotation, the load inside the cylinder travels along a path designated 14. The load travels with the cylinder for a substantial part of each revolution but as the load reaches an upper region it falls free and cascades on to an impact point 16.

The position of the impact point is dependent on the level of the load inside the cylinder. As the load level increases the point 16 rises and when the load level drops the point 16 drops as well. There is an optimum position for the impact point which corresponds to optimum operating conditions of the mill.

In accordance with the invention two microphones 18 and 20 respectively are employed as sound level sensors and are positioned spaced from one another in the direction of rotation of the cylinder on opposed sides of the impact point 16. Each microphone produces an electrical signal which is dependent on the sound level detected by the microphone and the signals are applied to a comparator 22. An output signal from the comparator is connected to a visual display 24 and to a control module 26. The control module produces control signals which are used to vary the rate at which ore is fed to the cylinder 10.

In use of the mill the load cascades on to the impact point 16 in the manner described. If the mill is charged to its optimum level and the microphones 18 and 20 are positioned equidistantly from the impact point 16 then the signals produced by the microphones are substantially equal and the control signal output by the comparator 22 reflects this. On the other hand if the mill carries too high a load then the impact point 16 moves upeardly towards the microphone 18 and the signal generated by this microphone exceeds that generated by the lower microphone 20. The comparator 22 detects the imbalance between the signals and the display 24 indicates that the impact point is moved away from the optimum position.

On the other hand if the mill is undercharged then the impact point 16 advances towards the microphone 20. The signal from this lower microphone then exceeds the signal from the upper microphone and in the manner described the control module 26 is actuated to cause the feed rate of ore to be increased In its simplest form the display 24 is a meter, with a centre zero point, and an indicator which departs from the centre point, in either direction, depending on the under-, or over-, loading of the mill as the case may be. Appropriate action could therefore be taken manually. Alternatively the control signal that is used to regulate the operation of the control module 26 so that, for example with the aid of a suitably programmed microprocessor, appropriate action is taken automatically to vary the feed rate of the ore.

The apparatus of the invention indicates whether a change in the power draft of a motor driving the mill is due to an increase, or decrease, in the load level of the mill. By means of a suitable control device e.g. a microprocessor, the information is used to regulate the feed rate of material to the mill to maximise the power draft. Thus the apparatus is suited specifically to be part of a system which varies the rate of feed of run of mine ore to an autogeneous, or semi-autogeneous, mill to maintain the optimum milling state. As variations in the composition of the run of mine ore cause the feed demand and maximum power draft to vary, a computer based control technique will normally be required to monitor the mill performance and to regulate the feed supply rate in the optimum way.

The control device, in effect, monitors the amplitude, and sense, of the control signal. For example if the control signal is positive the mill is overloaded. If the signal is negative the mill is underloaded. The amplitude of the signal indicates the degree of departure from the optimum loading position. It is thus straightforward to use the signal to control the feed rate of the ore to achieve a desired load level.

One benefit which arises through the use of the comparator, which essentially substracts one microphone signal from the other, is that compensation is automatically achieved for variations in the sound level in the mill which arise due to fluctuations in the density of the material in the mill. In other words a degree of autocorrelation is achieved which enhances the noise-immunity of the system.

The output signal of each microphone may be applied to an amplifier before being connected to the comparator. Initially the output signals from the amplifiers are balanced, under controlled conditions, to ensure that the apparatus is effectively calibrated for the particular installation.

Figure 2:
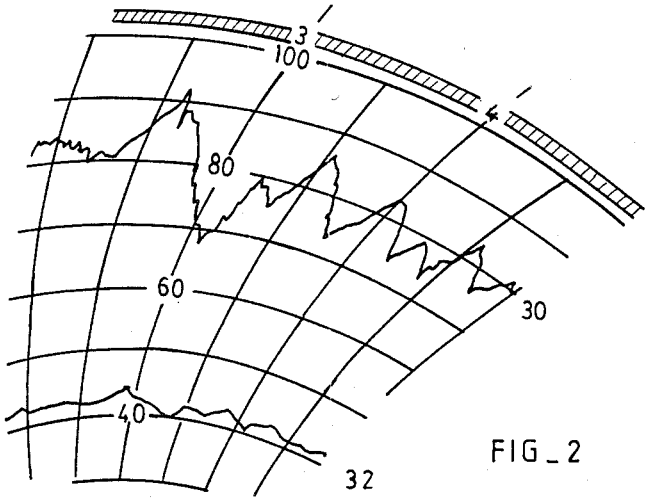
FIG. 2 shows portion of a chart used to record test results achieved with the aid of the apparatus.

FIG. 2 illustrates portion of a chart recording which carries a signal trace 30 produced by the comparator 22, and a trace 32 produced by load cells which were fitted to a test mill. The pens used for recording the traces were not in line, and this accounts for an offset between the traces. It is nonetheless quite clear that a very strong correlation exists between the two signals which demonstrates that the apparatus of the invention gives an accurate indication of the mill content.

We claim:

1. Apparatus for monitoring a level of a grinding charge in a grinding mill which rotates and thereby causes the charge to cascade on to an impact point within the mill, the location of the impact point being dependent on the grinding charge level, the apparatus including at least two sensors for detecting the prevailing sound level, the sensors being spaced from each other in the direction of mill rotation with the impact point between the sensors, and means for comparing signals which are produced by the sensors.

2. Apparatus according to claim 1 wherein the sensors are positioned so that they are equidistant from an impact point which corresponds to an optimum charge level.

3. Apparatus according to claim 1 wherein the comparison means generates a control signal which is used for regulating the rate of feed of ore into the mill.

4. Apparatus according to claim 1 which includes a display which is indicative of the position of the impact point.

* * * * *